United States Patent [19]

Weinberg

[11] Patent Number: 4,513,817

[45] Date of Patent: Apr. 30, 1985

[54] CASING BORE RECEPTACLE

[75] Inventor: Roger A. Weinberg, Houston, Tex.

[73] Assignee: Baker Oil Tools, Inc., Orange, Calif.

[21] Appl. No.: 432,210

[22] Filed: Oct. 1, 1982

[51] Int. Cl.[3] ..... E21B 23/02

[52] U.S. Cl. ..... 166/138; 166/217; 166/382

[58] Field of Search ..... 166/114, 115, 117, 162, 166/173, 181, 138, 216, 217, 382, 383

[56] References Cited

U.S. PATENT DOCUMENTS

| | | | |
|---|---|---|---|
| 2,948,338 | 8/1960 | Raulins et al. | 166/123 |
| 3,507,329 | 4/1970 | Stone, Jr. | 166/217 |
| 3,789,925 | 2/1974 | Brown | 166/217 |
| 3,990,510 | 11/1976 | Decuir | 166/217 |
| 4,281,711 | 8/1981 | Braddick et al. | 166/217 |
| 4,372,393 | 2/1983 | Baker | 166/382 |
| 4,437,522 | 3/1984 | Krause, Jr. et al. | 166/217 |

*Primary Examiner*—Stephen J. Novosad
*Assistant Examiner*—William P. Neuder
*Attorney, Agent, or Firm*—Norvell & Associates

[57] ABSTRACT

A sealing assembly comprising a casing bore receptacle, an annular packoff member, and a tubing carried mandrel for use in establishing sealing integrity between a fluid transmission conduit or tubing and an outer conduit or casing, is disclosed. The casing bore receptacle is incorporable in the casing and the annular packoff member is initially carriable on the mandrel. Seals on the interior and exterior of the packoff member establish a seal with the mandrel and the casing. Upon abutting engagement of the packoff member with the casing bore receptacle, a collet on the packoff member is released from the mandrel and cammed radially outward into engagement with the casing bore receptacle to anchor the packoff member to the casing bore receptacle. The mandrel can then move relative to the packoff member and the casing. A lock support sleeve is positioned intermediate the mandrel and the latching arms of the collet. Radially shiftable locking dogs carried by the lock support sleeve are engaged with a mandrel recess during run-in, with the collet arms in the anchored position, and with the body of the annular packoff during retrieval.

19 Claims, 6 Drawing Figures

CASING BORE RECEPTACLE

BACKGROUND OF THE INVENTION

1. Field of the Invention

This invention relates to sealing and packing systems used in subterranean oil and gas wells for providing an annular seal between a fluid transmission conduit disposed in another conduit, the most common example being to provide an annular seal between production tubing and casing.

2. Description of the Prior Art

There are many different downhole tools in the oil and gas industry which require that a seal be established in the annulus between a fluid transmission conduit or tubing string disposed in a well bore and the outer well casing. These tools may relate to the drilling and completion of the well, the production of the well, the servicing of the well, or the abandonment of the well. Conventional packers, employing an anchoring system for holding a sealing element in position against either upwardly or downwardly acting pressure differentials, are most often employed for establishing this seal. These conventional packers generally employ radially expandable anchor slip systems and radially expandable packing or sealing elements to prevent fluid communication and to provide pressure integrity. Such packers are typically run in and set in place either by or on a tubing string or a wireline setting tool. When set using a tubing string, the packer is typically set using hydraulic pressure in the tubing, hydrostatic pressure in the well bore, or a combination of both. It may also be mechanically set by the weight of the tubing. These packers can be permanent type packers with an internal seal bore for receiving tubing which can be retrieved while leaving the packer in place. Retrievable packers, employing techniques such as rotary manipulation of the tubing string to release anchor slip assemblies and packing elements for retrieval of the packing element, are also commonly employed.

It is generally necessary that sealing integrity be established between separate elements within the tubing string or between accessory items and the tubing string. For example, it is generally necessary that a tubing section, inserted into a seal bore of a packer, must have sealing integrity between that section and the packer. One means of providing such sealing integrity is to utilize stacks of sealing elements in which individual sealing elements have a generally chevron-shaped cross section. Sealing systems employing such chevron-shaped sealing elements are depicted on page 672 of the 1980–1981 Composite Catalog of Oilfield Equipment and Services published by World Oil. These chevron-shaped sealing elements and systems, commonly referred to as tubing seal systems, are generally employed to establish a seal between a tubing mounted element and the internal seal bore of a conventional packer. An alternative method of establishing a seal between a conventional packer and tubing elements while still permitting movement of the tubing elements relative to the packer, is depicted in U.S. Pat. No. 3,109,490 covering a slidable latching seal assembly.

In addition to the use of conventional packing elements to provide sealing integrity in the tubing casing annulus and to isolate the production zone from portions of the annulus extending above the packing element, casing polished bore receptacles have been employed in conjunction with sealing elements to achieve some of the objectives achieved by conventional packers. A typical prior art example of the use of packoff assemblies in conjunction with casing bore receptacles, or liners, is discussed on pages 6438 and 6439 of the 1978–79 Composite Catalog of Oilfield Equipment and Services published by World Oil.

In copending application Ser. No. 273,805, filed June 16, 1981, and assigned to the assignee of the instant invention, there is disclosed and claimed a packoff assembly which can be used in conjunction with a casing bore receptacle and a tubing mounted mandrel to provide a tubing-casing annular seal and to permit isolation of the production zone from the tubing-casing annulus. Such packoff assembly can be positioned at a precise location in the casing and will permit tubing movement which may result during a production or treating cycle.

Tubing movement is especially significant in deep hot wells. In deep hot wells, the tubing is originally landed at more or less than ambient well temperature. During treating operations, for example, if a cold acid is pumped down the tubing, the tubing would tend to undergo contraction. The tubing will elongate if heated by produced fluids. Some means for permitting tubing movement must therefore be provided. Tubing may tend to shrink because of a ballooning effect or as a result of helical buckling. The tubing may also be subjected to a compressive force, sometimes referred to as "piston effect", tending to shorten the tubing. This force is due to differential pressure acting on the end area of the tubing and that portion of a packoff assembly extending between the tubing and casing. The invention of the aforementioned copending application provides a means for attaching the tubing casing packoff assembly to the casing, thus eliminating any piston effect. By attaching the packoff assembly directly to the casing receptacle, the only force acting on the tubing would be that force developed by the pressure differential acting on the cross-sectional area of the tubing itself.

The structure disclosed in said copending application also permits the use of tubing seal systems to accomplish the sealing function otherwise achieved by the use of conventional radially expanding packing elements. With such construction, the cross-sectional area or gap across which the sealing elements must bridge is much less than that encountered when conventional packing elements are used. Significant radial expansion of the sealing elements themselves is therefore eliminated.

Conventional radially expanding packing elements generally required a complex means of expanding the packing element into and maintaining it in sealing engagement with the surface to be sealed. This means is sometimes further complicated by the necessity of providing expanding packing element retaining means to prevent extrusion of the packing element through the gap that it must bridge. On the other hand, the elements of tubing seal systems are energized by the pressure which they contain. They therefore need no mechanism to expand them and since the metal elements that retain them fit the sealing surface closely, there can be a very small gap that the seals must bridge. Contraction of the packoff assembly using a tubing seal system is, therefore, much more simple than one using conventional radially expanding packing elements.

The specific apparatus disclosed in the aforementioned copending application relied upon the expansion of collet arms to effect the securement of the packoff assembly to the casing receptacle. Such collet arms were forced outwardly into their latching position by a relative downward movement of the polished external surface of the mandrel which also cooperated in sealing relationship with internal seals of the packoff assembly. As the mandrel moved up and down in response to expansion or contraction movements of the tubing string, there was continuous frictional contact between the collet arms and the polished mandrel surface, thus creating the possibility of scratching and in any event producing a brinelling or localized hardening of the polished seal surface which adversely affected its cooperation with the internal seals of the packoff assembly.

Additionally, the packoff assembly of the aforementioned copending application was removed from engagement with the casing receptacle by upward movement of the tubing string and interconnected mandrel, which upward force was transmitted to the packoff assembly through the collet arms. In the event that the packoff assembly was wedged, jammed, or corroded in its installed position, there was the possibility of buckling the collet arms in the effort to effect the removal of the packoff assembly. Hence, further improvements in a packoff assembly utilizing an annular packoff member cooperable with a casing bore receptacle are desirable.

SUMMARY OF THE INVENTION

The instant invention provides an annular packoff member for cooperation with a casing bore receptacle defining an internal polished surface. A tubing carried mandrel, having a polished external surface, is utilized to run the packoff assembly into the casing and, when the packoff assembly is anchored to the casing receptacle through the outward camming of the radial arms of a collet, the polished external surface of the mandrel cooperates in sealing relationship with internal seals of the packoff assembly. The collet arms are initially retained in a fixed, contracted position in a recessed lower portion of the mandrel by a retaining sleeve. After run-in to a position adjacent the casing seal bore receptacle, pressurized fluid is supplied to the annulus between the tubing string and the casing wall to maintain a downward force on the packoff assemblage. Upward movement of the mandrel produced by lifting the tubing string then effects the shearing of a shear pin which holds the collet arm retaining sleeve in a fixed position relative to the mandrel. Subsequent downward movement of the mandrel effects the release of the collect arm retaining sleeve from the collet arms and concurrently moves a peripherally spaced array of radially shiftable locking dogs, carried by a lock support sleeve surrounding the mandrel, into adjacent relationship with respect to recesses provided on the internal sides of the collet arms, thus locking the collet arms in their expanded position wherein upwardly facing shoulders on the collet arms engage a downwardly facing shoulder on the receptacle sleeve. The collet is supported by the support sleeve rather than the polished surface of the mandrel in the set position.

Moreover, to retract the packoff assembly, the initial upward movement of the mandrel will effect the release of the peripheral array of locking dogs from their expanded retaining position with respect to the collet arms. Further upward movement of the tubing string and mandrel will cause the locking dogs to engage a mandrel recess and then move the lock support sleeve upwardly into engagement with a downwardly facing surface on the packoff assembly and thus apply a retracting force directly to the seal body element carrying the internal and external sealing assemblages. In this manner, no substantial forces are transmitted through the collet arms to the packoff assembly, and the possibility of buckling such arms during retrieval is eliminated.

Further advantages of the invention will be readily apparent to those skilled in the art from the following detailed description, taken in conjunction with the annexed sheets of drawings on which is shown, by way of example only, a preferred embodiment of the invention.

BRIEF DESCRIPTION OF THE DRAWINGS

FIG. 2 depicts the shearing of a pin attaching the collet to the mandrel for run-in.

DESCRIPTION OF THE PREFERRED EMBODIMENT

Figure 1A:
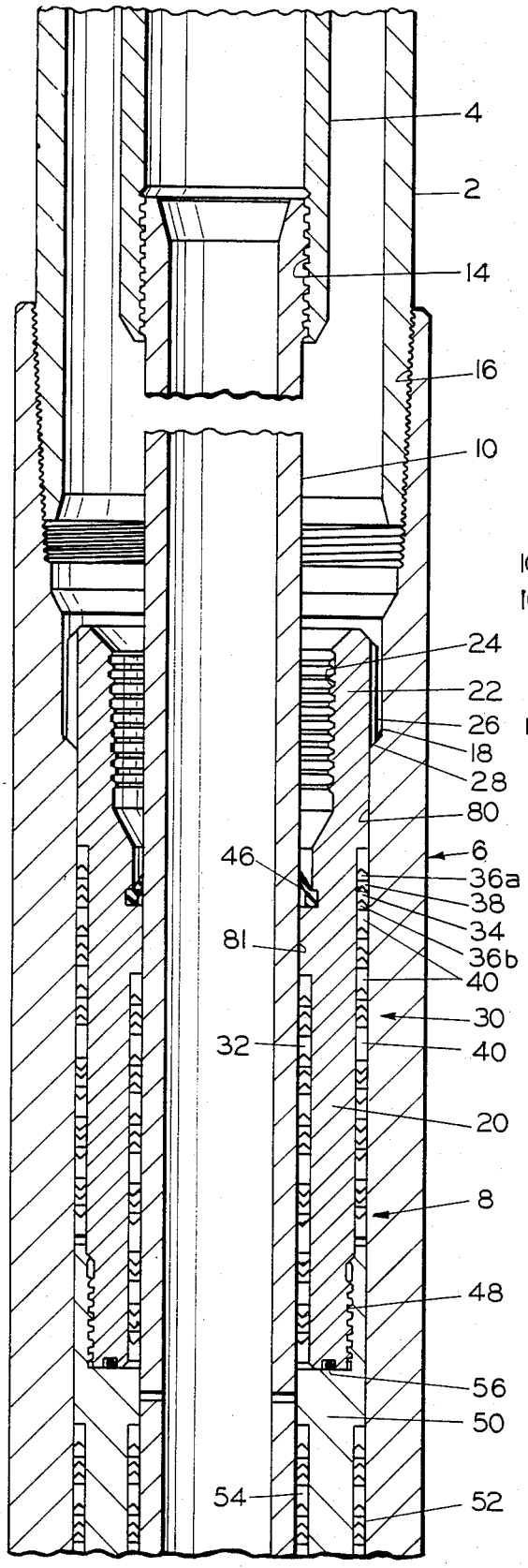
FIG. 1 is divided into three sections (FIGS. 1*a*, 1*b*, and 1*c*) which comprise longitudinal sections depicting the casing bore receptacle, the packoff member, and the mandrel, all positioned prior to latching of the packoff member with the casing bore receptacle.

The seal assembly provided by the preferred embodiment of this invention provides a means for isolating the annular area between an oil well casing 2 and a tubing string or fluid transmission conduit 4 and the production zone (not shown). This annular area extends above the production zone, and isolation is provided by means of the interaction between a casing polished bore receptacle 6, which comprises an integral part of the casing, and an annular packoff member 8 initially carried on a mandrel 10. Mandrel 10 is carried as an integral part of tubing string 4 and is attached to the tubing 4 by means of threaded connection 14. The annular packoff member 8 employs seal stacks on inner and outer cylindrical surfaces to establish sealing integrity between the casing bore receptacle 6 and packoff member 8, and between packoff member 8 and mandrel 10.

Casing polished bore receptacle 6 is incorporated in casing 2 when the casing is first installed in a subterranean oil or gas well. Producing zones would be identified prior to installation of casing 2 and, in the preferred embodiment of this invention, a casing bore receptacle 6 would be installed just above a producing zone. Casing bore receptacle 6 is attached to casing 2 by means of threaded connection 16 at its upper end. A similar threaded connection 17 is located at the lower end of the casing bore receptacle and provides similar attachment to those portions of casing 2 extending below the casing bore receptacle. An upwardly facing shoulder or first stop 18 is located on the inner surface of casing bore receptacle 6 just below threaded connection 16. This upwardly facing shoulder is commonly referred to in the art as a no-go shoulder. A downwardly facing shoulder or second stop 76 is located adjacent the bottom of casing bore receptacle 6. The cylindrical surface 80 extending between shoulders 18 and 76 provides a suitable sealing surface against which seals on packoff member 8 can act to form an appropriate seal. The inner diameter of polished bore 80 is less than the normal inner diameter of casing 2. However, this reduction in the diameter of the casing need not be large and would not appreciably change the cross-sectional area of the casing.

Figure 1B:
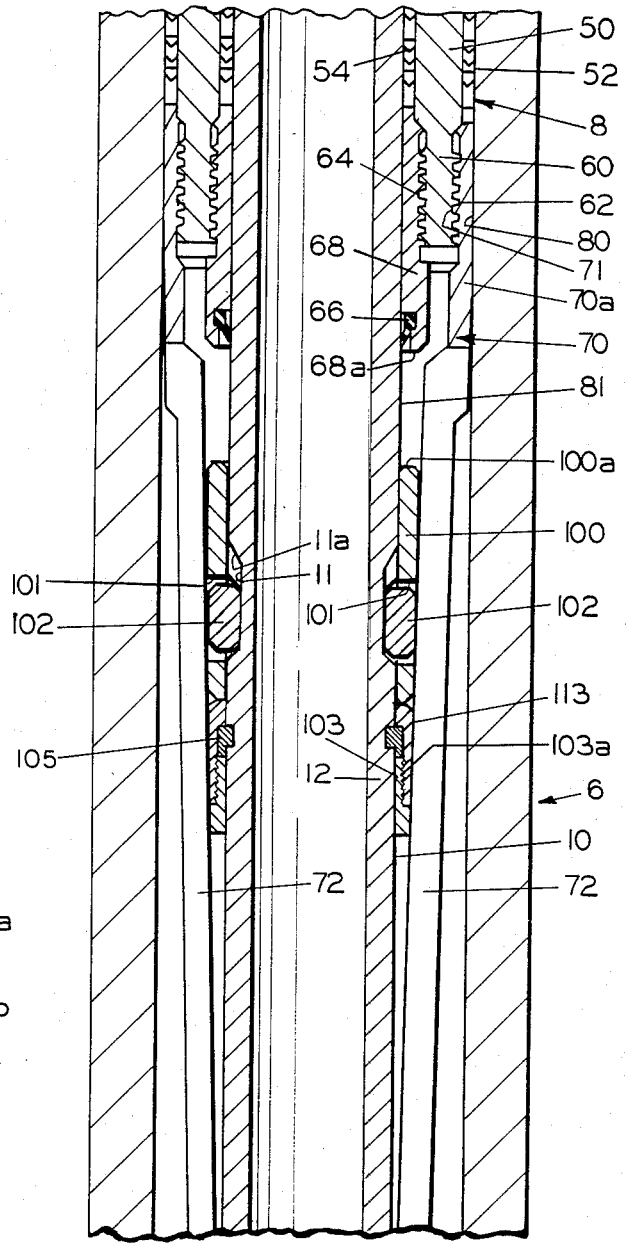

At the point at which it becomes necessary to insert a fluid transmission conduit or production tubing 4 and to isolate the production zones from the casing by preventing communication of produced fluids between the production zones and the tubing casing annulus, the mandrel and packoff assembly comprising portions of this invention would be inserted into a well on the lower end of the production string 4. Mandrel 10 generally comprises a cylindrical member having a sealing surface 81 formed on its upper portion and a recessed surface 82 adjacent its lower end. A downwardly facing shoulder 84 extends between mandrel sealing surface 81 and recessed surface 82. In the preferred embodiment depicted in FIG. 1, mandrel 10 comprises the lowermost section of tubing string 4. In alternate embodiments of this invention, not shown specifically herein, additional portions of standard tubing could be inserted below the location of mandrel 10. The length of mandrel 10, and particularly sealing surface 81, would be determined by the extent of longitudinal movement of the tubing string anticipated in the particular oil well completion in which this assembly is to be used. Perhaps the most common applications in which this invention would be used would require a mandrel section on the order of 22 feet in length.

Packoff member 8 is initially carriable on mandrel 10. In the preferred embodiment of this invention, packoff member 8 is attached to mandrel 10 by means of an interconnection involving collet 70, guide member 120 and a retaining sleeve 112. Packoff member 8 surrounds the outer periphery of mandrel 10 and, in the position shown in FIGS. 1*a*, 1*b*, and 1*c*, packoff member 8 occupies the annular space between casing bore receptacle 6 and mandrel 10. Packoff member 8 comprises an upper body section 20 having a female left hand square thread 24 in its upper cylindrical end 22. Cylindrical end section 22 also has an enlarged section 26 at its upper end. Enlarged section 26 has a downwardly facing annular shoulder or radially extending abutting means 28 at its lower end and, in the position shown in FIG. 1*a*, downwardly facing shoulder 28 abuts upwardly facing shoulder 18 of casing bore receptacle 6 to prevent movement of packoff member 8 down the oil well past casing bore receptacle 6.

Seal stacks 30 and 32 are shown on the outer and inner cylindrical surfaces of upper body section 20. These seal stacks comprise a plurality of chevron-shaped sealing members. Each seal stack is shown with three individual sub-assemblies of seal members facing in opposite directions. Although various conventional sealing assemblies could be employed with this invention, the particular sealing elements depicted in the preferred embodiments comprise a primary elastomeric sealing member which can provide adequate sealing integrity in the presence of high pressure differentials. For example, an elastomeric sealing member utilizing a perfluoroelastomer, such as the elastomer commonly referred to under the DuPont trademark "Kalraz", can be used effectively in this invention. Each individual seal subassembly also comprises two relatively rigid back up members 36*a* and 36*b* on opposite ends of elastomeric member 34. Back up members 36*a* and 36*b* can comprise a material formed generally of polyphenylene sulfide, commonly referred to to under the Phillips Petroleum Corporation trademark "Ryton". An intermediate back up member 38 immediately adjacent to the convex surface of elastomer member 34 is also shown in each seal assembly used in this invention. This intermediate back up member can comprise a member formed of polytetrafluoroethylene with glass filler material interspersed therein, commonly referred to as glass filled "Teflon", a trademark of DuPont Corporation. These chevron-shaped sealing assemblies do not require the application of a mechanical compressive force in order to energize the sealing elements, and such chevron-shaped members generally have a relatively small radial width. Metal spacer members 40 are also shown between adjacent seal subassemblies. An elastomeric scraper member 46 is shown mounted on the inner surface of packoff upper body member 20. This scraper member acts to prevent the build up of sludge or other material on the outer surface of mandrel 10. Inner and outer seal stacks 32 and 30, as well as 54 and 52, are generally flush with the cylindrical surfaces of packoff member 8.

Packoff member 8 also comprises a lower body member 50 threadably engaged with upper body member 20 by means of threaded connection 48. An O-ring seal 56 is positioned along the interface between the lower surface of upper packoff body member 20 and lower packoff body member 50. Outer and inner seal assemblies 52 and 54, generally equivalent to seal assemblies 30 and 32, are mounted along lower packoff body member 50 and similarly provide sealing integrity between the polished bore 80 of casing bore receptacle 6, mandrel sealing surface 81, and the packoff member 8. An annular threaded extension 60 extends from the lower portion of packoff body member 50 and has threaded connections 62 and 64 along its outer and inner surfaces. The outer threaded connection 62 engages threaded connections 71 on the ring portion 70*a* of a collet member 70. The inner threaded connection 64 engages mating threads on seal retainer 68, which also holds an elastomeric lower scraper member 66 similar to upper scraper member 46.

Figure 1C:
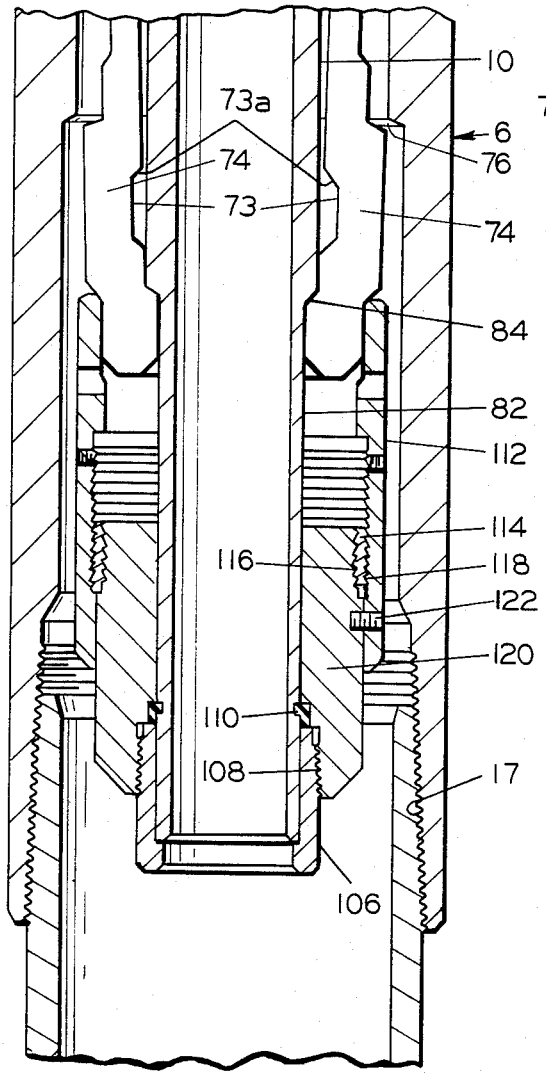

Collet 70 has a plurality of peripherally spaced, axially extending collet arms 72 secured to ring portion 70*a* and terminating in collet head members 74. The head members thus comprise a radially expandable latching means and are normally spring urged inwardly into a position of abutment with the recessed portion 82 of the mandrel 10, as shown in FIG. 1*c*. In the preferred embodiment of this invention, the collet heads 74 are retained in this position during run in by a disengagable retaining sleeve 112 which is secured by shear pin 122 to an annular guide 120. Guide 120 is secured to the bottom end of the mandrel 10 by a C-ring 110 which is inserted in an appropriate annular recess in the bottom end of the mandrel 10 and is secured to the guide 120 by an externally threaded cap sleeve 106 which snugly surrounds and abuts the bottom end of mandrel 10 and is threadably secured to internal threads 108 provided in the bottom end of the guide 120.

A body lock ring 114 is provided with internal and external wicker threads 116 and 118 which engage corresponding threads respectively provided on the exterior of the top portion of the guide 120 and the interior of the lower portion of the retaining sleeve 112.

Figure 2:
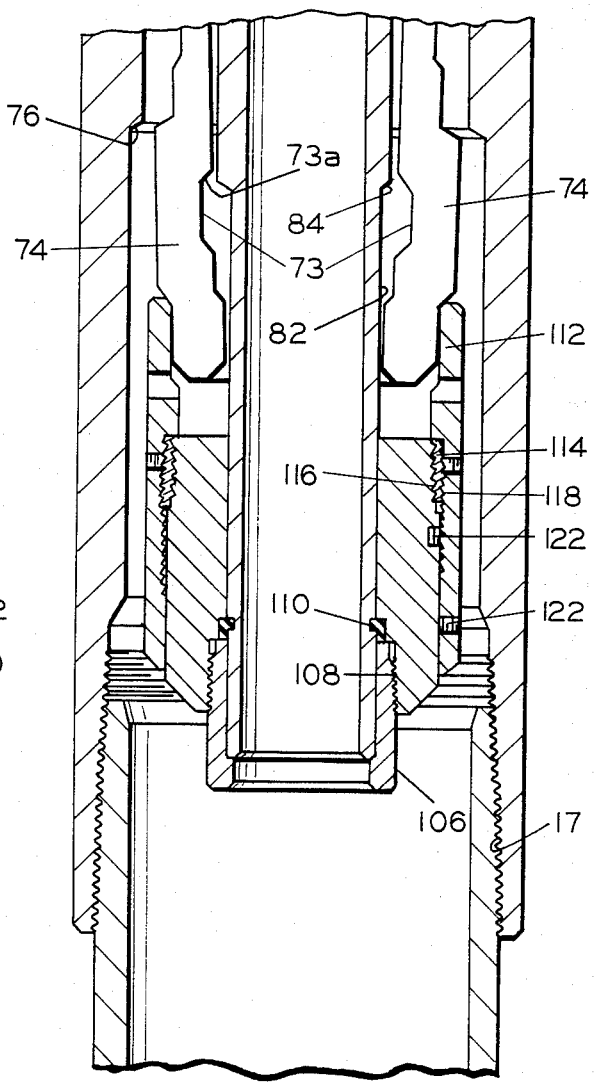

When the packoff assemblage has been run into the well to the position where shoulder 28 of the packoff member 8 engages the upstanding shoulder 18 on the casing bore receptacle 6, the collet locking heads 74 are disposed just below and in the vicinity of the downwardly facing shoulder 76 provided in the casing bore receptacle 6. Since the annulus between the mandrel 10 and the casing bore receptacle 6 is sealed by the engagement of the seal assemblies 30, 32, 52 and 54 carried by the annular packoff member 8 with the exterior of the mandrel 10 and the sealing bore surface 80, fluid pressure may be applied to such annular packoff member to produce an effective downward force thereon, hence securing the collet 70 in the aforedescribed position. Upward movement of mandrel 10 will thus effect the shearing of shear pin 122 and upward movement of guide sleeve 120 with respect to the retaining sleeve 112. The effect of the upward movement of the mandrel 10 is illustrated in FIG. 2 wherein it will be seen that the guide sleeve 120 has advanced upwardly relative to the retaining sleeve 112 and is secured in its upwardly displaced position by the wicker threads 116 and 118. Hence, upon subsequent downward movement of the mandrel 10, the top end of the retaining sleeve 112 is removed from engagement with the locking heads 74 of collet 70 and such heads are free to be moved outwardly into engagement with the downwardly facing shoulder 76 of the casing receptacle 6.

Such outward displacement of the collet locking heads 74 is initially effected by the downwardly facing shoulder 84 provided at the top of the recessed mandrel portion 82. As the mandrel 10 is moved further downwardly relative to the collet 70. a locking dog support sleeve 100 is moved beneath the inner ends of the collet locking heads 74. The locking dog support sleeve 100 surrounds mandrel 10 and is provided with a plurality of peripherally spaced apertures 101 for respectively accommodating a plurality of radially shiftable locking dogs 102. In the run-in position of the apparatus, the locking dogs 102 are retained within mandrel recess 11 by the abutting engagement of the collet locking arms 72.

The locking dog support sleeve 100 is positioned on mandrel 10 in the vicinity of the locking dog recess 11 by a ring 103 which is held in position by a split shear ring 105 located within a cooperable recess on the surface of mandrel 10. Ring 103 is externally threaded as indicated at 103*a* and an internally threaded retaining ring 113 is engaged with such threads. It should be noted that the top end surface 100*a* of locking dog support sleeve 100 is spaced below the end face 68*a* of the seal retainer 68 (FIG. 1*b*), thus permitting a limited amount of upward relative movement of the mandrel 10 with respect to the packoff member 8 for the purposes that were heretofore described.

Figure 3:
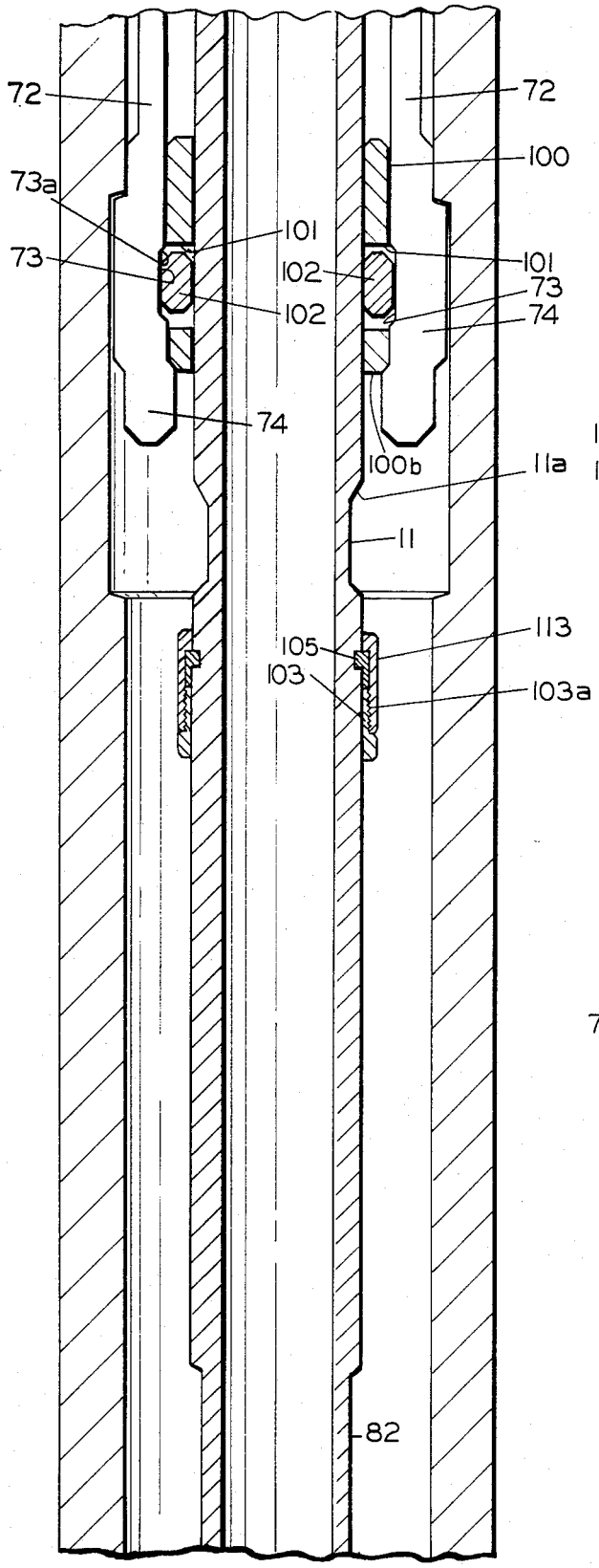
FIG. 3 is a view similar to FIG. 1*c* but showing the elements in the installed position of the packoff member.
Figure 4:
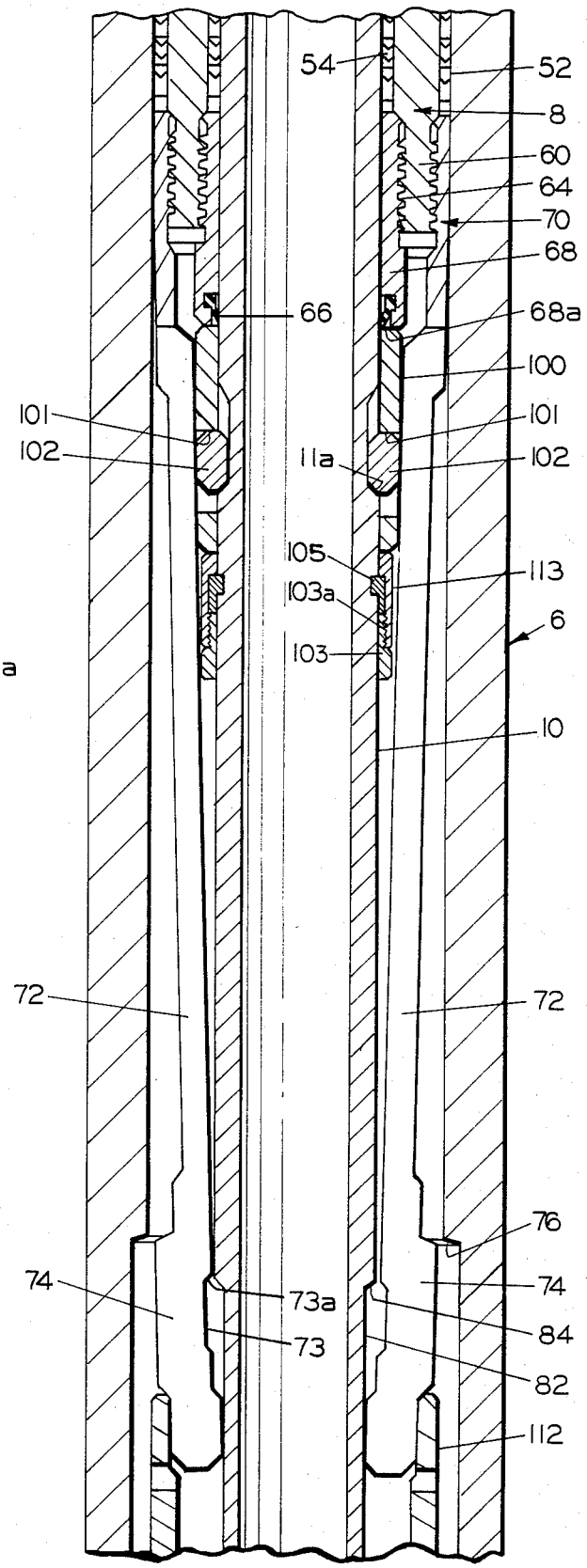
FIG. 4 is a view similar to FIG. 1*b* but showing the elements in the extraction position of the mandrel.

As the mandrel 10 is moved downwardly, a downwardly facing shoulder 100*b* on support sleeve 100 engages a cooperable surface on the interior of collet head 74 to position the sleeve 100 between the mandrel 10 and collet heads 74. The locking dogs 102 are aligned with a recess 73 provided in the interior surfaces of the locking heads 74 and move outwardly into such recesses under the camming action of the inclined mandrel shoulder 11*a* provided at the top of the dog receiving mandrel recess 11. Hence, the collet locking heads 74 are retained in their outwardly displaced or set positions with the locking dogs 102 positioning the sleeve 100 between the latching collet head 74 and mandrel 10, wherein the packoff assemblage is secured to the casing bore receptacle 6 against upward or downward relative movements, as illustrated in FIG. 3. The mandrel 10 is then moved downwardly to position the polished surface 81 centrally relative to the inner seal stacks 32 and 54.

In this position, the mandrel 10 is free to move relative to both the packoff member 8 and the casing receptacle 6, and the polished external surface 81 provided on the upper portions of mandrel 10 cooperates with the internal seal assemblies 32 and 54 provided on the packoff member 8. Hence, the contraction or expansion of the tubing string 4 in response to temperature variations or other causes is readily permitted by movement of the mandrel 10 without in any manner disturbing the effectiveness of the seals provided by the annular packoff member 8.

In the set position of FIG. 3, locking collet heads 74 are radially supported by cylindrical sleeve 100. If axial forces are transmitted to collets 70, an inward camming force on the collet heads 74 will be established. The collet heads 74 will be supported by cylindrical sleeve 100 rather than mandrel 82 when these inward forces act on the collet heads. The inward force will not be transmitted to the mandrel 10. Thus, the polished surface of mandrel 10 will not be damaged as the mandrel shifts relative to the collet heads 74, either as a result of movement of the mandrel, or of expansion and contraction of the mandrel.

When, for any reason, it is desired to extract the packoff assemblage from the well, this may be readily done by applying an upward force to the mandrel 10. As the mandrel 10 moves upwardly, the locking dog recess 11 in mandrel 10 is aligned with the radially expanded locking dogs 102 and they move into locking dog recess 11 by the inherent spring forces existing in the collet arms 72 and the camming action of recess shoulders 73*a*. The collet locking heads 74 are thus freed from engagement with the downwardly facing shoulder 76 of the casing bore receptacle 6. The locking dog support sleeve 100 is then moved upwardly with the mandrel 10 and the top end face of locking dog support sleeve 100 engages the bottom end face 68*a* of seal retainer 68, thus applying a direct extraction force through the threaded connections 64 to the packoff member 8. Accordingly, the extraction of the packoff member 8 does not involve the application of any significant upward force to the collet arms 72. It is always possible that the assembly may become lodged in the well and cannot be extracted in the normal manner. The application of prescribed upward force greater than normal extraction force will disengage shear rings 105 and 110 permitting removal of the mandrel 10 with the packoff member 20 remaining in place.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A packoff assembly for a casing bore receptacle defining a polished bore surface, comprising: an annular seal carrier having an abutting means for engaging said casing bore receptacle, external seal means on said annular seal carrier for establishing sealing integrity with said polished bore surface; a tubing connectable mandrel having a polished external cylindrical surface portion cooperable with said internal seal means; radially shiftable latching means carried on said annular seal carrier; expanding means on said mandrel for expanding said latching means into engagement with said casing bore receptacle; an axially shiftable support sleeve surrounding a portion of said mandrel; and positioning means for concurrently positioning said support sleeve between said mandrel and said latching means when said latching means are engaged with said casing bore receptacle, and for locking said latching means in said engaged position, said mandrel being axially shiftable relative to said support sleeve when said positioning means are supported by said support sleeve rather than by said mandrel polished external cylindrical surface.

2. The packoff assembly of claim 1 wherein said abutting means comprises a downwardly facing no-go shoulder on said annular seal carrier for engaging a cooperable upwardly facing shoulder on the casing bore receptacle.

3. The packoff assembly of claim 1 wherein said expanding means comprises a shoulder on said mandrel engagable with said latching means upon relative axial movement between said mandrel and said latching means to cam said latching means into engagement with said casing bore receptacle.

4. The packing assembly of claim 1 wherein said positioning means comprises locking means axially shiftable between first and second postiions, said locking means securing said support sleeve to said mandrel in the first position and securing said support sleeve to said latching means in said second position.

5. The packoff member of claim 4 wherein said locking means comprises a radially shiftable locking dog carried by said support sleeve, said locking dog being engagable with a first groove on said mandrel in the first position, and engagable with a second groove on said latching means in the second position.

6. The packoff member of claim 5 wherein the upper end face of said lock support sleeve abuts the lower end face of said annular seal carrier upon upward movement of said mandrel, with said locking dog engagable with said first groove, whereby said seal carrier is supported by said support sleeve during extraction of said mandrel and said seal carrier.

7. A sealing assembly pursuant to claim 4 wherein said lock support sleeve abuts the lower end of said packoff member during extraction movement of said mandrel.

8. The packoff member of claim 1 wherein said positioning means further comprises a downwardly facing shoulder on said support sleeve engagable with a cooperable upwardly facing shoulder on said latching means.

9. The packoff means of claim 1 further comprising disengagable means for securing said latching means to said mandrel during run-in, said disengagable means being responsive to upward movement of said mandrel to release said latching means from said mandrel, said expanding means expanding said latching means upon subsequent downward movement of said mandrel.

10. A packoff assembly for a casing seal receptacle defining a polished bore surface intermediate upwardly and downwardly facing shoulders, comprising: an annular seal carrier having a downwardly facing shoulder abuttable with said upwardly facing shoulder of said casing seal receptacle, external seal means on said annular seal carrier for establishing sealing integrity with said polished bore surface; internal seal means on said annular seal carrier; a tubing connectable mandrel having a polished external cylindrical surface portion cooperable with said internal seal means; a collet secured to said annular seal carrier and surrounding another portion of said mandrel; said collet having locking arms securing said collet and said annular seal carrier to said mandrel for run-in; shearable means responsive to movement of said mandrel relative to said annular seal carrier for releasing said collet locking arms from said mandrel for outward movement to engage the downwardly facing shoulder on the casing seal receptacle, thereby securing the packoff assembly to the casing seal receptacle; a lock support sleeve surrounding said other portion of said mandrel and lying between said mandrel and said collet locking arms; and radially shiftable lock means on said lock support sleeve engaging only said mandrel in the run-in and extraction positions of said mandrel relative to said annular seal carrier and engaging said collet locking arms in the installed positions of said mandrel to secure said collet locking arms beneath said downwardly facing shoulder of said casing seal receptacle.

11. A packoff assembly pursuant to claim 6 wherein the upper end face of said lock support sleeve abuts the lower end face of said annular seal carrier during extraction movements of said mandrel.

12. An assembly adapted to isolate the annular area thereabove between a first fluid transmission conduit and a second, exterior conduit in a subterranean well from a production zone therebelow, said assembly comprising: a casing bore receptacle incorporable in said exterior conduit and having a polished internal seal bore surface therein, an annular seal carrier having an abutting means for engaging said casing bore receptacle, external seal means on said annular seal carrier for establishing sealing integrity with said polished bore surface; internal seal means on said annular seal carrier; a tubing connectable mandrel having a polished external cylindrical surface portion cooperable with said internal seal means; radially shiftable latching means carried on said annular seal carrier; expanding means for expanding said latching means into engagement with said casing bore receptacle to secure said annular seal carrier to said casing bore receptacle; an axially shiftable support sleeve surrounding a portion of said mandrel; and positioning means for positioning said support sleeve between said mandrel and said latching means when in engagement with said casing bore receptacle, said mandrel being axially shiftable relative to said support sleeve when said positioning means is engaged, whereby radial loads applied to said latching means are supported by said latching means are supported by said support sleeve rather than by said mandrel polished external cylindrical surface.

13. The assembly of claim 12 wherein said casing seal receptacle comprises an upwardly facing shoulder cooperable with said annular seal carrier abutting means and a downwardly facing shoulder cooperable with said latching means carried on said annular seal carrier.

14. An assembly adapted to isolate the annular area thereabove between a fluid transmission conduit and the casing in a subterranean well from a production zone therebelow, said assembly comprising:

a casing bore receptacle incorporable in said casing and having a sealing bore therein and a downwardly facing shoulder adjacent said sealing bore;

a tubular mandrel incorporable in said fluid transmission conduit having a radially inwardly extending first recess therein;

a packoff member initially carriable on said tubular mandrel for run-in and having inner and outer sealing elements for establishing sealing integrity with said casing and said mandrel, and an annular shoulder having an outer diameter greater than the inner diameter of said casing sealing bore, said shoulder abutting said casing bore receptacle to prevent movement thereof past said casing bore receptacle;

radially expandable latching means secured to said packoff member, said latching means having latching arms initially in a retracted position with said latching arms being received within said first recess, said latching arms being expandable upon movement of said mandrel with said packoff member held stationary relative to said casing bore receptacle;

said mandrel having a polished cylindrical portion cooperable with said inner sealing element;

a locking dog support sleeve surrounding said mandrel and disposed within said latching arms;

a plurality of peripherally spaced locking dogs mounted in said support sleeve for radial movements;

said locking dogs being inwardly restrained by said latching arms during run-in;

a second recess on said mandrel receiving said locking dogs during run-in whereby said locking dog support sleeve is movable with said mandrel;

said latching arms having internal recesses respectively receiving said locking dogs when moved downwardly by said mandrel to hold said latching arms outwardly in locked engagement with said downwardly facing shoulder of said casing bore receptacle, thereby releasing said dogs from said mandrel second recess; and a downwardly facing shoulder on said packoff member abuttable by said locking dog support sleeve upon upward movement of said mandrel to remove the packoff assembly from the well.

15. An assembly adapted to isolate the annular area thereabove between a fluid transmission conduit and the casing in a subterranean well from a production zone therebelow, said assembly comprising:

a casing bore receptacle incorporable in said casing and having a sealing bore therein and a downwardly facing shoulder below said sealing bore;

a tubular mandrel incorporable in said fluid transmission conduit having a radially inwardly extending first recess therein and a downwardly facing shoulder adjacent the upper end of said recess;

a packoff member initially carriable on said tubular mandrel for run-in and having inner and outer sealing elements for establishing sealing integrity with said casing and said mandrel, and an annular shoulder having an outer diameter greater than the inner diameter of said casing sealing bore, said shoulder abutting said casing bore receptacle to prevent movement thereof downwardly past said casing bore receptacle;

a radially expandable collet secured to said packoff member, said collet having latching arms initially releasably affixed to said mandrel for run-in in a retracted position with said collet arms being received within said first recess, said collet arms being releasable upon movement of said mandrel with said packoff member held stationary relative to said casing bore receptacle;

said mandrel having an upper polished cylindrical portion cooperable with said inner sealing element;

a locking dog support sleeve surrounding another lower portion of said mandrel and disposed within the latching arms of said collet;

a plurality of peripherally spaced locking dogs mounted in said support sleeve for radial movements;

said other portion of said mandrel having a second recess initially receiving said locking dogs during run-in whereby said locking dog support sleeve is movable downwardly with said mandrel;

said downwardly facing shoulder on said mandrel engaging said collet arms to move said collet arms outwardly by downward movement of said mandrel relative to said packoff member:

said collet arms having internal recesses respectively receiving said locking dogs when moved downwardly by said mandrel to hold said mandrel collet arms in locked engagement with said downwardly facing shoulder of said casing receptacle, thereby releasing said dogs from said mandrel recess; and a downwardly facing shoulder on said packoff member carrier abuttable by said locking dog support sleeve upon upward movement of said mandrel to remove the packoff assembly from the well.

16. An assembly adapted to isolate the annular area thereabove between a fluid transmission conduit and the casing in a subterranean well from a production zone therebelow, said assembly comprising:

a casing bore receptacle incorporable in said casing and having a sealing bore therein and a downwardly facing shoulder below said sealing bore;

a tubular mandrel incorporated on said fluid transmission conduit having a radially inwardly extending recess therein;

a packoff member initially carriable on said tubular mandrel for run-in and having inner and outer sealing elements for establishing sealing integrity with said casing and said mandrel, and an annular shoulder having an outer diameter greater than the inner diameter of said casing sealing bore, said shoulder abutting said casing bore receptacle to prevent movement thereof downwardly past said casing bore receptacle;

said mandrel having a polished cylindrical portion cooperable with said inner sealing element;

a radially expandable collet secured to said packoff member, said collet having latching arms initially releasably affixed to said mandrel for run-in in a retracted position with said collet latching arms being received within said mandrel recess;

shearable means responsive to movement of said mandrel relative to said packoff member for releasing said collet arms from said mandrel to engage said downwardly facing shoulder on the casing seal receptacle, thereby installing the packoff member;

a lock support sleeve surrounding said other portion of said mandrel, said sleeve being axially shiftable relative to said mandrel; and radially shiftable lock means on said lock support sleeve engaging said mandrel in the run-in and extraction positions of said mandrel relative to said annular seal carrier and engaging said collet arms in the installed position of the packoff member, said lock support sleeve being disposed intermediate said collet arms and said mandrel in the installed position of said packoff member to lock said collet arms in engagement with the casing seal receptacle and prevent contact of said collet arms with said mandrel.

17. A sealing assembly pursuant to claim 16 wherein said lock support sleeve abuts the lower end of said packoff member during extraction movement of said mandrel.

18. A sealing assembly pursuant to claim 17 further comprising disengagable shear means on said mandrel for supporting said lock support sleeve during extraction of said assembly, said disengagable shear means being releasable upon application of a prescribed upward force greater than the normal extraction force.

19. An assembly adapted to isolate the annular area thereabove between a fluid transmission conduit and the casing in a subterranean well from a production zone therebelow, said assembly comprising:

a casing bore receptacle incorporated in said casing and having a sealing bore therein and a downwardly facing annular shoulder adjacent said sealing bore;

a tubular mandrel incorporable on said fluid transmission conduit having a radially inwardly extending recess therein and a downwardly facing shoulder adjacent the upper end of said recess;

a packoff member initially carriable on said tubular mandrel for run-in and having inner and outer sealing elements for establishing sealing integrity with said casing and said mandrel, and an annular shoulder having an outer diameter greater than the inner diameter of said casing sealing bore, said shoulder abutting said casing bore receptacle to prevent continued movement thereof downwardly past said casing bore receptacle;

said mandrel having a polished cylindrical upper portion cooperable with said inner sealing element;

a radially expandable collet secured to said packoff member, said collet having locking arms initially releasably affixed to said mandrel for run-in in a retracted position with said locking arms being received within said mandrel recess;

shearable means responsive to upward movement of said mandrel relative to said annular seal carrier for releasing said collet locking arms from said mandrel recess to engage said downwardly facing shoulder on the casing seal receptacle, thereby installing the packoff assembly;

a lock support sleeve surrounding a lower portion of said mandrel; said sleeve being axially shiftable relative to said mandrel and lying between said mandrel and said collet locking arms; and radially shiftable locking means on said lock support sleeve engaging said mandrel in the run-in and extraction positions of said mandrel relative to said annular seal carrier and engaging only said collet locking arms in the installed position of said packoff member, thereby securing said collet locking arms in engagement with said casing receptacle shoulder and permitting unrestricted axial movements of said mandrel within said sleeve without contact with said collet locking arms.

* * * * *